United States Patent [19]

Sugino et al.

[11] Patent Number: 4,500,262

[45] Date of Patent: Feb. 19, 1985

[54] VARIABLE PRESSURE AND DISPLACEMENT RECIPROCATING PUMP

[75] Inventors: Kenji Sugino; Yukiaki Nagata, both of Uozu, Japan

[73] Assignee: Sugino Machine Limited, Uozu, Japan

[21] Appl. No.: 143,317

[22] Filed: Apr. 24, 1980

[30] Foreign Application Priority Data

May 8, 1979 [JP] Japan ..... 54-55212

[51] Int. Cl.[3] ..... F04B 49/08

[52] U.S. Cl. ..... 417/214; 417/216

[58] Field of Search ..... 417/212, 214, 385–388, 417/215, 216; 92/13.1

[56] References Cited

U.S. PATENT DOCUMENTS

| | | | |
|---|---|---|---|
| 3,005,412 | 10/1961 | Camp | 103/38 |
| 3,250,218 | 5/1966 | Sinclair | 417/216 |
| 3,301,195 | 1/1967 | Streeter | 417/471 |
| 3,306,042 | 2/1967 | Crooks | 417/387 X |
| 3,816,028 | 6/1974 | Schouteeten et al. | 417/214 |
| 4,006,797 | 2/1977 | Keske | 417/214 X |
| 4,015,913 | 4/1977 | Nakamura | 417/471 |
| 4,080,108 | 3/1978 | Keske et al. | 417/214 |

FOREIGN PATENT DOCUMENTS

| | | | |
|---|---|---|---|
| 77631 | 12/1893 | Fed. Rep. of Germany . | |
| 405223 | 12/1909 | France . | |
| 1234813 | 10/1960 | France . | |
| 1382195 | 10/1963 | France | 417/214 |
| 603 | 2/1967 | Japan | 417/214 |
| 694442 | 7/1951 | United Kingdom . | |

*Primary Examiner*—Carlton R. Croyle
*Assistant Examiner*—Edward Look
*Attorney, Agent, or Firm*—Cooper, Dunham, Clark, Griffin & Moran

[57] ABSTRACT

The present invention relates to a reciprocating pump in which a plunger is reciprocated by means of a crankshaft, a connecting rod and a crosshead. The reciprocating pump further includes cushioning means which is disposed between the crosshead and the plunger and capable of adjusting its cushioning force and absorbing the plunger stroke, whereby the delivery pressure is adjustable through adjustment of the cushioning force of the cushioning means and the delivery volume or rate is also adjustable through absorption of the plunger stroke by the cushioning means.

5 Claims, 3 Drawing Figures

VARIABLE PRESSURE AND DISPLACEMENT RECIPROCATING PUMP

BACKGROUND OF THE INVENTION

The present invention relates to reciprocating pumps.

In the past, so-called plunger pumps have been mostly so designed that the setting pressure is adjusted by allowing an amount of fluid exceeding the setting pressure to escape to the outside through a pressure regulating valve disposed in a fluid delivery circuit. On the other hand, the displacement is adjusted by such methods as adjusting the amount of eccentricity of the crankshaft, adjusting the number of revolutions of the pump, varying the plunger diameter and so on. However, these prior art methods have the disadvantages of resulting in complicated mechanisms, requiring complex operations, wasting power uselessly, making it difficult to ensure stable delivery or flow rate and so on.

SUMMARY OF THE INVENTION

It is therefore the object of the present invention to provide a reciprocating pump having pressure and displacement adjusting means, which overcomes the foregoing deficiencies in the prior art, is simple in construction and is capable of easily varying the pressure and displacement.

To accomplish the above and other equally important objects, the present invention comprises a reciprocating pump in which a plunger adapted to be reciprocated by means of a crank or crankshaft, a connecting rod and a crosshead is coupled to the crosshead by way of cushioning means having adjustable cushioning force and capable of absorbing the stroke of the plunger. In one form of the pump according to the invention, the cushioning means for coupling the crosshead and the plunger to each other may include a fluid pressure cylinder connected to an adjustable fluid pressure generating means and an accumulator. In another form, the cushioning means may include an extension having one end attached to the rear end of the plunger and the other end slidably fitted in the crosshead and a spring mounted on the outer surface of the extension so that the crosshead is always urged in the backward direction and the set spring force is adjustable as desired.

DESCRIPTION OF THE PREFERRED EMBODIMENTS

Figure 1:
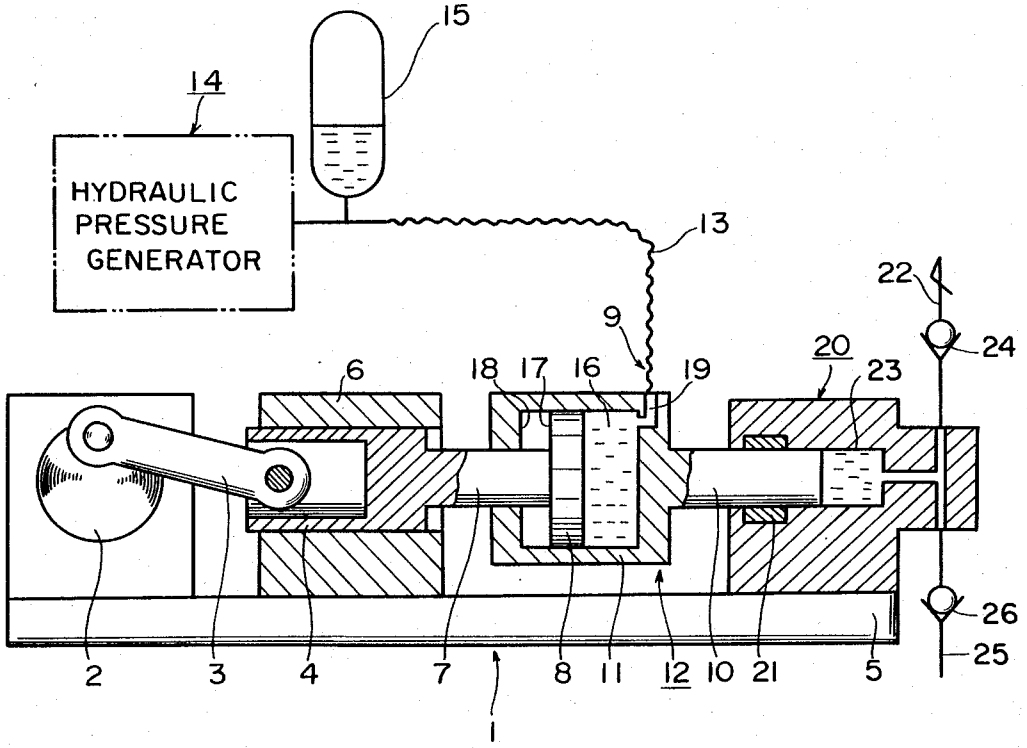
FIG. 1 is a longitudinal sectional view showing a first embodiment of the present invention.

In the first embodiment of the invention shown in FIG. 1, numeral 1 designates a pump system, 2 a crankshaft, and 3 connecting rod having one end rotatably pivoted to the crankshaft 2 and the other end rotatably pivoted to a crosshead 4. The crosshead 4 is axially slidably fitted in a supporting member 6 which is fixedly mounted on a base 5 so that the crosshead 4 can be reciprocated by means of the crankshaft 2 and the connecting rod 3. A piston rod 7 is extended integrally from the other end of the crosshead 4, and attached to the end of the piston rod 7 is a piston 8 having a predetermined pressing sectional area.

Numeral 9 designates a cushioning means comprising a cylinder and piston unit 12 including the piston 8 and a cylinder 11 having the piston 8 slidably mounted therein and a plunger 10 attached to the forward end thereof and a hydraulic pressure generator 14 and an accumulator 15 which are arranged to communicate with the head side of the cylinder and piston unit 12 by way of a flexible pipe 13. The accumulator 15 is designed so that its volume becomes very great as compared with that of a cylinder chamber 16, and a rear end face 17 of the piston 8 is adapted to be pressed against a cylinder inner wall rear end face 18. Numeral designates a communication hole for communicating the cylinder chamber 16 with the flexible pipe 13.

The plunger 10 of a reciprocating pump is attached to the cylinder 11 at its forward end center so as to be integral therewith and has a predetermined pressing sectional area. Numeral 20 designates a delivery head which is fixedly mounted in place on the base 5 so that the plunger 10 is slidably fitted in cylindrical bore 23 and supported in the delivery head 20. Numeral 21 designates a packing, and 22 a delivery circuit connected to the delivery head 20 and provided with a check valve 24. An inlet line 25, provided with a check valve 26, admits fluid from a suitable source to the pump delivery head 20.

With the construction described above, the operation of the first embodiment will now be described.

Initially, the crankshaft 2 is rotated through the operation of a prime mover which is not shown. At this time, the pressure in a cushioning circuit comprising the cylinder chamber 16, the communication hole 19, the flexible pipe 13 and the accumulator 15 is maintained at atmospheric pressure or a pressure as low as about atmospheric pressure, and the volume of the accumulator 15 is selected very large as compared with that of the cylinder chamber 16 so that the pressure in the cushioning circuit varies very slightly even if the entire volume of the cylinder chamber 16 is received. Thus, even if the delivery circuit 22 is clogged, the crankshaft 2 will be operated under a very small load. When the prime mover or the crankshaft 2 is brought into a normal operation, the hydraulic pressure generator 14 is brought into operation so that the hydraulic pressure in the cushioning circuit is raised to a desired level and then the hydraulic pressure generator 14 is disconnected with the cushioning circuit to stop its operation. In this case, since the hydraulic pressure generator 14 has no bearing on the displacement of the pump system 1 but it is provided only for the purpose of increasing the pressure in the cushioning circuit, it may be a small capacity unit. After the pressure in the cushioning circuit has been increased, the piston 8 attached to the extension 7 of the crosshead 4 is alternately moved back and forth by the rotation of the crankshaft 2 through the connecting rod 3 and the crosshead 4, so that during the compression stroke the piston 8 is moved forward against the pressure in the cushioning circuit and the oil in the cylinder chamber 16 is forced into the accumulator 15 thus performing a work of displacing the oil having a pressure P and a volume V or $W=P\times V$.

On the other hand, during the suction stroke the piston 8 is moved backward by the pressure in the cushioning circuit and it is now subjected to a work $W=P\times V$ contrary to the case during the compression stroke. Since the volume of the accumulator 15 is selected very great as compared with that of the cylinder chamber 16, the difference in pressure P between the beginning and end of the compression stroke as well as between the beginning and end of the suction stroke is very small.

Figure 2:
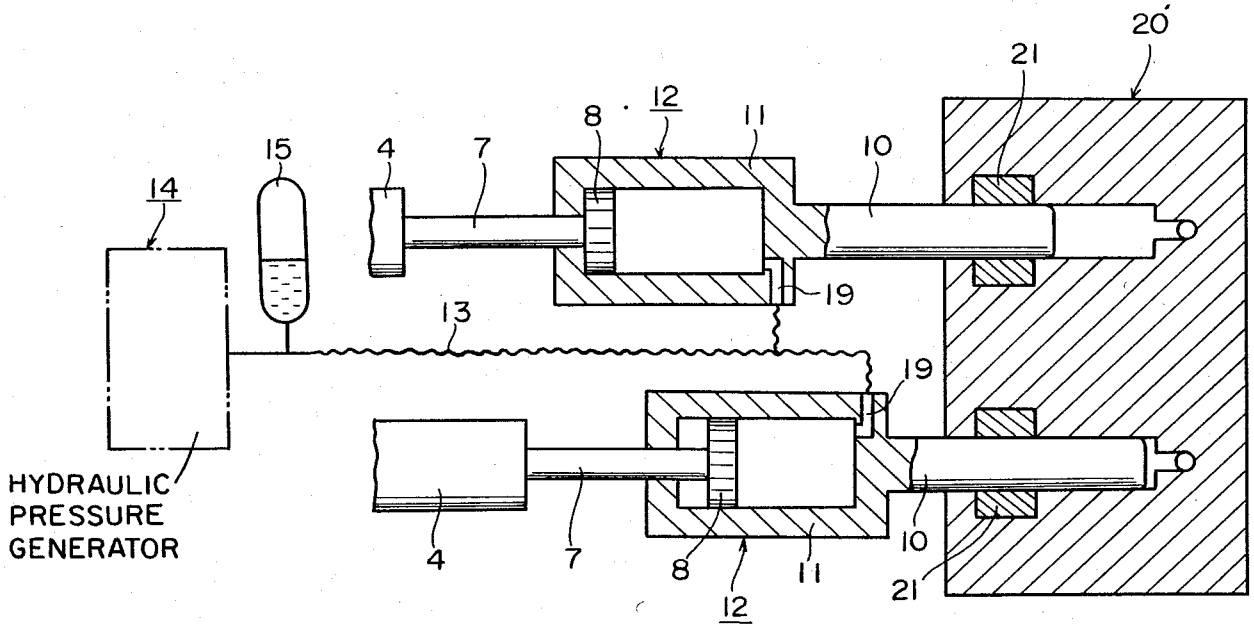
FIG. 2 is a longitudinal sectional view showing the manner in which two units of the pump shown in FIG. 1 are arranged in a duplex manner.

FIG. 2 shows an arrangement in which two sets of the pump system shown in FIG. 1 are arranged in parallel and 180° apart in phase with respect to each other and the respective cylinder and piston units 12 have their head sides communicated with the hydraulic pressure generator 14 and the accumulator 15 through the flexible pipe 13. This duplex pump arrangement is advantageous in that due to the pump operation mentioned previously, the work performed by one of the pump systems on the compression stroke will be compensated by the work to which the other pump system is subjected on the suction stroke, with the result that as long as there is no delivery, the pump systems will be operated under no-load condition substantially only with a power consumption required by the mechanical loss.

Next, the operation of the delivery circuit 22 for fixed delivery purposes will be described. On the compression stroke the piston 8 attached to the crosshead 4 is moved forward by the rotation of the crankshaft 2. In this case, due to the construction of the pump system 1, the delivery circuit 22 operates in such a manner that the product of the pressure in the delivery circuit 22 or the delivery head 20 and the plunger pressing sectional area is always balanced against the product of the pressure in the cylinder chamber 16 and the pressing sectional area of the piston 8. More specifically, where the delivery volume of the delivery circuit 22 is equal to the full stroke volume of the plunger 10, the cylinder 11 having the integrally formed plunger 10 is moved forward at the same speed with the crosshead 4 having the integrally formed piston 8. On the contrary, where the delivery circuit 22 is throttled so that its delivery volume is smaller than the full stroke volume of the plunger 10, the forward moving speed of the plunger 10 or the hydraulic cylinder 11 becomes lower than that of the crosshead 4 or the piston 8, with the result that the piston 8 is relatively slid within the hydraulic cylinder 11 in accordance with the difference in speed between the piston 8 and the hydraulic cylinder 11 and thus the oil in the cylinder chamber 16 is displaced and forced into the accumulator 15 through the communication hole 19 and the flexible pipe 13. On the suction stroke, the piston 8 is urged by the pressure in the cushioning circuit to move backward within the hydraulic cylinder 11. In this case, the hydraulic cylinder 11 is kept at rest for the distance travelled by the piston 8 within the hydraulic cylinder 11 during the compression stroke and consequently only the piston 8 is moved within the hydraulic cylinder 11. After the piston rear end face 17 has come into contact with the cylinder rear end face 18, the crosshead 4 is moved backward by the rotation of the crankshaft 2 and the plunger 10 is moved backward by means of the piston 8 and the hydraulic cylinder 11, thus causing the plunger 10 to reciprocate over the minimum required stroke.

If two sets of the pump system are arranged in parallel as illustrated in FIG. 2 and displace in phase by 180 degrees with respect to each other, due to the same operation mentioned previously, practically the required power is reduced to that required for the stroke of the plungers 10 and the movements of the pistons 8 within the cylinders 11 compensate each other thus producing no effect on the consumption of power. A comparison between a prior art pump system having an external discharge type pressure regulating valve and this duplex pump arrangement shows that if all the fluid corresponding to the full plunger stroke volume is first raised to the working pressure and then any excessive pressure is released to the outside by the pressure regulating valve, the required power always represents an amount corresponding to the full pump capacity or the full load power, whereas in accordance with this invention the required power decreases with a decrease in the working capacity and the required power increases with an increase in the working capacity, thus contributing greatly to the saving of energy. It will be apparent from the foregoing description that the setting of the pressure in the delivery circuit 22 can be easily changed by changing the pressure in the cushioning circuit.

Figure 3:
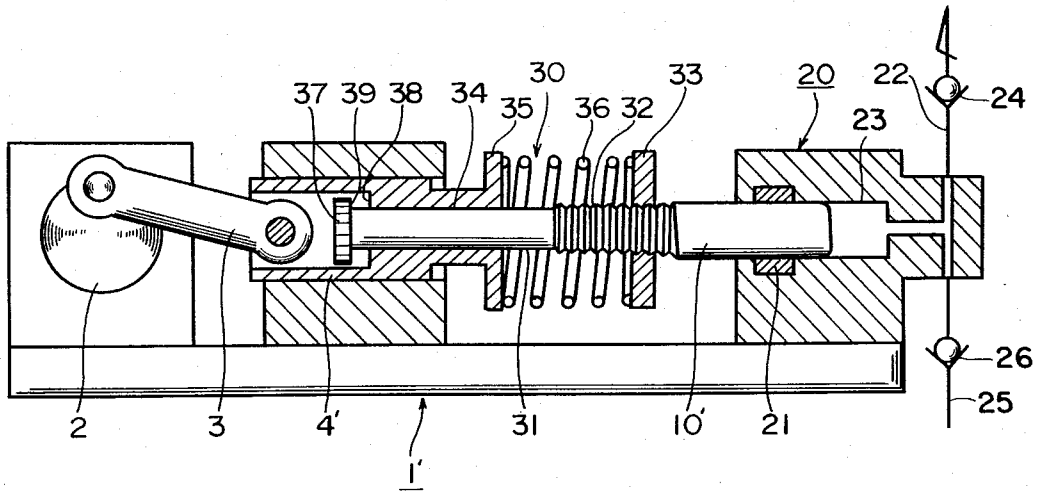
FIG. 3 is a longitudinal sectional view showing a second embodiment of the invention.

Referring to FIG. 3 showing a second embodiment of the invention, a cushioning means 30 comprises an extension from the plunger rear end whose rear end is slidably fitted in the crosshead and a spring mounted on the outer surface of the extension so as to always urge the crosshead in the backward direction. More specifically, an extension 31 of a predetermined length is made integral with the rear end of a plunger 10' and an external thread 32 is formed in the plunger-side outer surface of the extension 31. A pressure adjusting nut 33 is engaged with the thread 32 and the rear end portion of the extension 31 is slidably fitted in a guide hole 34 formed in the crosshead 4' whose forward end is formed with a large diameter portion 35. A spring 36 is mounted on the outer surface of the extension 31 between the pressure adjusting nut 33 and the large diameter portion 35. Numeral 37 designates an abutting large diameter portion formed at the rear end of the plunger extension 31 so as to abut on a crosshead inner wall end face 38.

The operation of the second embodiment will now be described. Firstly, where a delivery circuit 22 is at a fixed delivery operation, on the compression stroke the crosshead 4' is moved forward against the spring force of the spring 36 by the rotation of a crankshaft 2 and the resulting compression of the spring 36 moves the plunger 10' forward. In this case, if the delivery rate of the delivery circuit 22 is equal to the full stroke volume of the plunger 10', the plunger 10' is moved forward at the same speed with the crosshead 4'. When the delivery circuit 22 is throttled so that its delivery volume becomes smaller than the full stroke volume, the forward moving speed of the plunger 10' becomes lower than that of the crosshead 4'. In this case, the speed difference is absorbed by the plunger extension 31 slidably fitted in the crosshead 4' and the excessive force is stored in the spring 36. On the suction stroke, initially the crosshead 4' is moved backward by the spring force of the spring 36 and then the end face 39 of the extension end large diameter portion 37 abuts against the crosshead inner wall 38 thus causing the plunger 10' to move backward. Thus the plunger 10' is reciprocated with the minimum required stroke. In this case, the pressure in the delivery circuit 22 can be easily varied by adjusting the distance between the crosshead large diameter portion 35 and the pressure adjusting nut 33 and by varying the spring force of the spring 36.

It will thus be seen from the foregoing description that although simple in construction, the pump according to the present invention can be easily changed in pressure and volume setting and thus the pump can be advantageously used in applications involving liquids whose external release is difficult or dangerous, such as, harmful liquids or liquefied gases or liquids whose external release changes their properties, such as, solutions of high polymer compounds.

We claim:

1. In a positive displacement reciprocating pump having an inlet check valve and a discharge check valve wherein a plunger is reciprocated in a cylinder through a crank shaft, a connecting rod and a crosshead, means for varying pressure and displacement of said reciprocating pump characterized in that said crosshead and said plunger are coupled to each other by cushioning means comprising a piston rod integrally extended from a forward end of said crosshead and provided at the end thereof with a piston having a larger cross-sectional area than that of said piston rod and of said plunger disposed in a fluid pressure cylinder having said plunger attached to the forward end thereof, said piston being slidably mounted in said cylinder, and fluid pressure generating means and an accumulator which are arranged to communicate with a head side of said cylinder.

2. A variable pressure and variable displacement reciprocating pump having a plurality of plungers (10) each of which is reciprocated in a cylinder provided with an inlet check valve and an outlet check valve in a predetermined phase relationship with one another by means of a crankshaft (2), and each of which is provided with a connecting rod (3) and a crosshead (4), characterized in that said crosshead (4) and said plunger (10) are coupled to each other by cushioning means (9) comprising a piston rod (7) integrally extended from a forward end of said crosshead (4) and provided at the end thereof with a piston (8) having a cross-sectional area larger than that of said piston rod and of said plunger disposed in a fluid pressure cylinder (11) having said plunger attached to the forward end thereof, said piston (8) being slidably mounted in said cylinder (11), and a variable fluid pressure generating means (14) and an accumulator (15) in communication with the head side of each of said cylinders (11) simultaneously thereby to provide a variable pressure and displacement reciprocating pump.

3. A reciprocating pump according to claim 2, characterised by an assembly of two variable pressure and displacement reciprocating pumps as aforesaid wherein the crossheads (4) of the pumps are operated out of phase with one another by 180° of crankshaft rotation, and the head side of the cylinder (11) of each pump is connected to a single fluid pressure generating means (14) and an associated accumulator (15).

4. A reciprocating pump comprising a plurality of plungers (10) each of which is reciprocated in a cylinder provided with an inlet check valve and an outlet check valve in a predetermined phase relationship with one another by means of a crank shaft (2), connecting rods (3) and crossheads (4') characterized in that each of said crossheads (4') and said plungers (10) are coupled to each other by cushioning means (30) comprising an extension (31) having one end attached to a rear end of said plunger (10') and the other end portion slidably fitted in said crosshead (4'), and a spring (36) mounted on an outer surface of said extension (31) such that said crosshead (4') is always urged in a rearward direction and a spring force setting of said spring is adjustable, thereby to provide a variable pressure and displacement reciprocating pump.

5. A reciprocating pump according to claim 4, characterised in that said spring (36) is mounted between a forward end (35) of said crosshead (4') and a pressure adjusting nut (33) fitted on an outer surface portion of said plunger extension (31) which is close to said plunger (10).

* * * * *